US007686049B2

(12) United States Patent
Hwang

(10) Patent No.: US 7,686,049 B2
(45) Date of Patent: Mar. 30, 2010

(54) HEAD COVER FOR GOLF CLUBS

(76) Inventor: Yun Sik Hwang, 553-6 Il-dong, Sangrok-ku, Ansan-si, Kyounggi-do (KR)

( * ) Notice: Subject to any disclaimer, the term of this patent is extended or adjusted under 35 U.S.C. 154(b) by 1073 days.

(21) Appl. No.: 11/358,719

(22) Filed: Feb. 22, 2006

(65) Prior Publication Data

US 2006/0201596 A1 Sep. 14, 2006

(30) Foreign Application Priority Data

Mar. 3, 2005 (KR) ..... 10-2005-0017911
Feb. 8, 2006 (KR) ..... 10-2006-0012085

(51) Int. Cl.
*B65D 65/02* (2006.01)

(52) U.S. Cl. ..... 150/160; 206/188

(58) Field of Classification Search ..... 150/160; 206/818; 24/303
See application file for complete search history.

(56) References Cited

U.S. PATENT DOCUMENTS 3,133,577 A * 5/1964 Bellevue, Sr. ..... 150/160
4,378,832 A 4/1983 Thompson
5,000,238 A 3/1991 Zeller
5,002,185 A 3/1991 Schurman
5,050,655 A 9/1991 Borenstein
5,284,194 A 2/1994 Gaffney
5,682,653 A * 11/1997 Berglof et al. ..... 24/303
5,819,829 A 10/1998 Matthews
6,044,880 A 4/2000 Maeng
6,119,742 A 9/2000 Maeng
6,192,950 B1 2/2001 Maeng
6,202,723 B1 3/2001 Maeng
6,484,771 B2 * 11/2002 Kloos et al. ..... 150/160
6,874,627 B2 4/2005 Maeng
2005/0016648 A1 * 1/2005 Vakharia et al. ..... 150/160

FOREIGN PATENT DOCUMENTS

JP 2002-95779 * 2/2002
JP 2003-225335 * 8/2003

* cited by examiner

*Primary Examiner*—Tri M Mai
(74) *Attorney, Agent, or Firm*—Gilberto M. Villacorta; Matthew Kremer; Foley & Lardner LLP

(57) ABSTRACT

The disclosed head cover for golf clubs is designed to be conveniently and rapidly placed upon or removed from a head of a golf club. The head cover may include a head receiving part and a shaft receiving part that extends longitudinally from the head receiving part. The shaft receiving part can have the shape of a bird bill and may comprise facing upper and lower mandibles. The mandibles may be the same length and be formed by two slots which extend in parallel from opposite sides of an end opening to the head receiving part. A fastening member can be provided on each of the upper and lower mandibles and may detachably fasten the mandibles to each other by a magnetic force. The fastening member may include magnets and a metal plate.

11 Claims, 7 Drawing Sheets

HEAD COVER FOR GOLF CLUBS

CROSS-REFERENCE TO RELATED PATENT APPLICATIONS

Korean Priority Application 10-2005-0017911, filed Mar. 3, 2005, including the specification, drawings, claims and abstract, are incorporated herein by reference in its entirety. Korean Priority Application 10-2006-0012085, filed Feb. 8, 2006, including the specification, drawings, claims and abstract, are incorporated herein by reference in its entirety.

BACKGROUND

The present invention relates generally to a head cover for golf clubs, and more particularly to a head cover for golf clubs, which is suitable for covering the head of a golf club, especially a driver or wood.

FIG. 1 is a head cover for a driver, which is disclosed in U.S. Patent Application Publication No. 2005/0016648 (published on Jan. 27, 2005). The head cover 1 for golf clubs, according to this document, includes a head receiving part 2 and a shaft receiving part 3, which integrally extends from the head receiving part 2. The shaft receiving part 3 has on an end thereof an opening 4. A slot 5 extends from a position on the opening 4 to the head receiving part 2 and is expanded into a "V" shape. Further, the head cover includes a fastening member 6 to fasten both edges of the slot 5 to each other. A head cover for golf clubs, having the same construction, is also disclosed in U.S. Pat. No. 6,874,627 (issued Apr. 5, 2005), which shows a fastening member of the head cover comprising a hook means or a magnet. However, the fastening means of U.S. Patent Application Publication No. 2005/0016648 is limited to a magnet.

In the above-mentioned head cover 1 for golf clubs, the slot 5 may be expanded into a "V" shape so that the head cover 1 is placed upon or removed from a head portion of a golf club. However, it is very complicated to completely open the slot 5. Moreover, even when the slot 5 is completely opened, a passage for the club head is so narrow that it is inconvenient and difficult to put on or remove the head cover 1. Thus, if excessive force is applied to put on or remove the head cover 1, the slot 5 may be undesirably torn at an end 7 thereof.

SUMMARY

Accordingly, there is a need to provide a head cover for golf clubs, which is more conveniently and rapidly put on or removed from a head of a golf club. There is also a need to provide a head cover for golf clubs, which may be used without worry about damage. An embodiment of the present disclosure may satisfy these needs by making a shaft receiving part in the shape of a bird bill, which extends from a head receiving part.

One embodiment of the present invention provides a head cover for golf clubs, which includes a head receiving part that receives a head of a golf club therein and a shaft receiving part that extends from the head receiving part, that receives a shaft portion adjacent to the head, and that has the shape of a bird bill. The shaft receiving part may comprise facing upper and lower mandibles. The upper and lower mandibles have the same length and are formed by two slots which extend in parallel from opposite sides of an end opening to the head receiving part. In addition, the head cover may includes a fastening member, which detachably fastens the upper and lower mandibles of the shaft receiving part to each other.

According to an embodiment of the present invention, the shaft receiving part may open simply by pulling the upper and lower mandible apart. Just as the bill of a bird is opened, the shaft receiving part may fully be opened. Thus, it is possible to conveniently and rapidly put on or remove the head cover.

DETAILED DESCRIPTION

Figure 1:
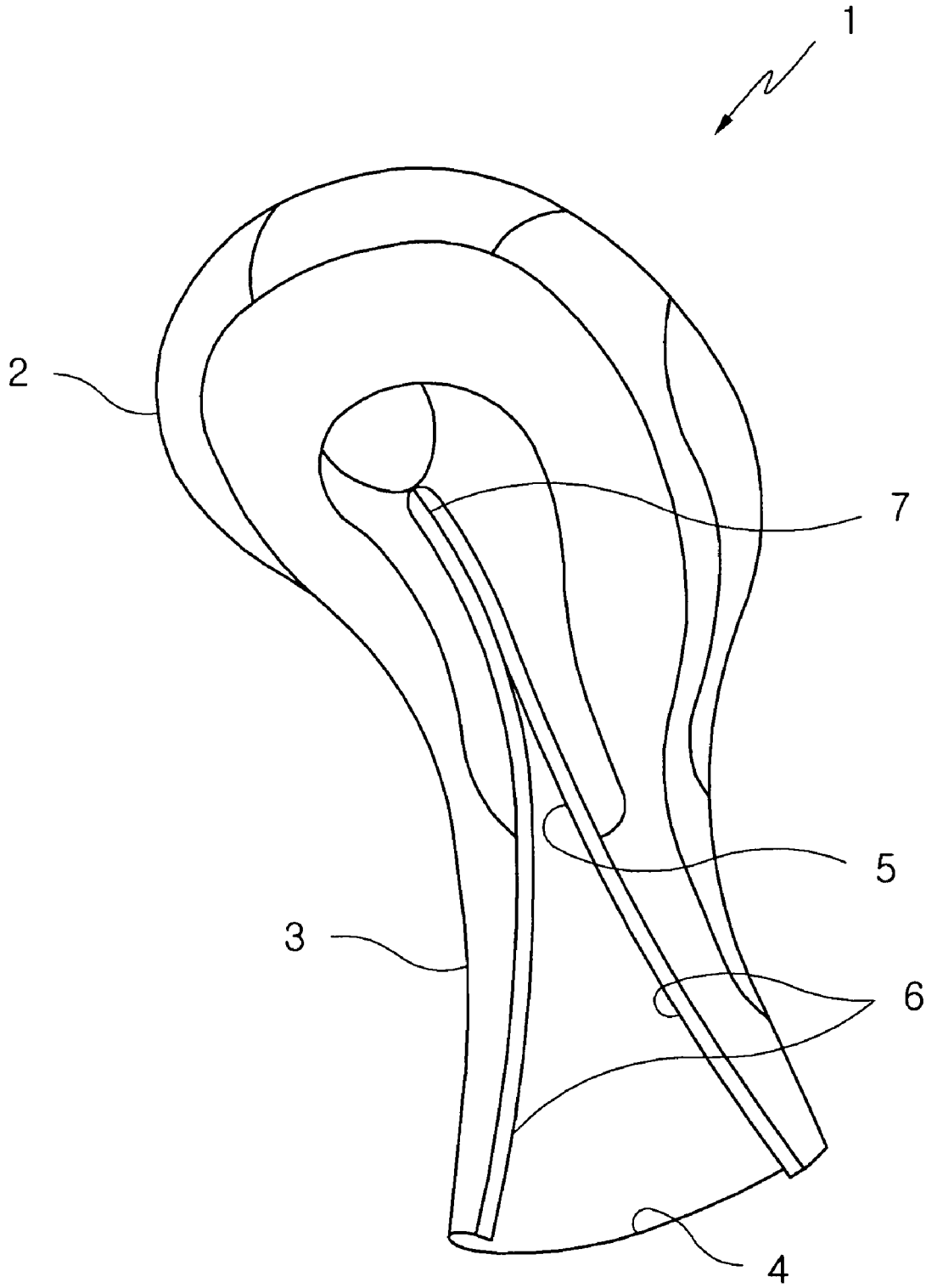
FIG. 1 (PRIOR ART)
FIG. 1 is a perspective view of a conventional head cover for golf clubs.

The above and other objects, features and other advantages of the present invention will be more clearly understood from the following detailed description taken in conjunction with the accompanying drawings. In the drawings, a head cover for golf clubs according to an embodiment of the present invention is denoted by reference numeral 10.

Figure 2:
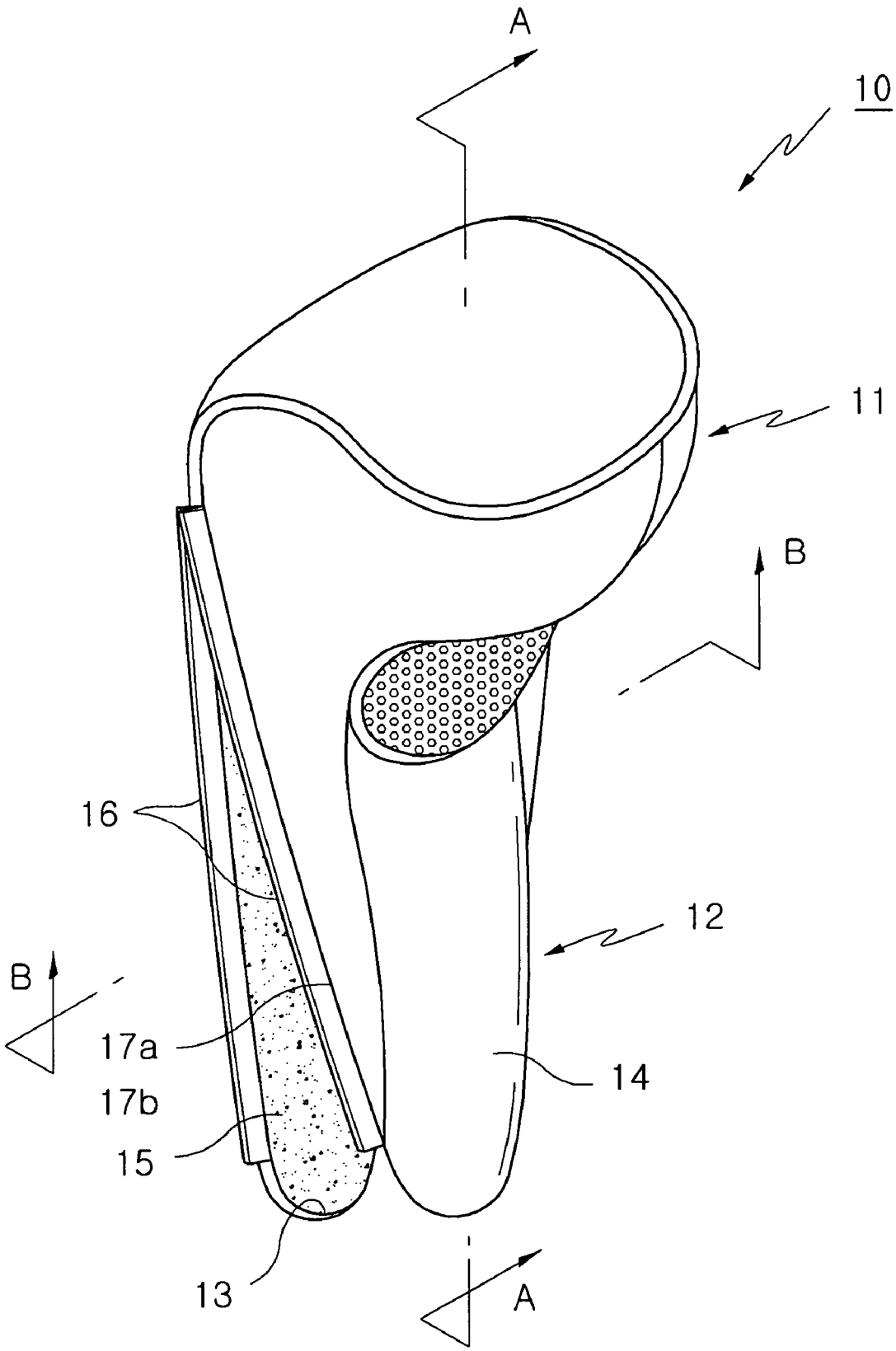
FIG. 2 is a perspective view of a head cover for golf clubs according to one embodiment of the present invention.
Figure 3:
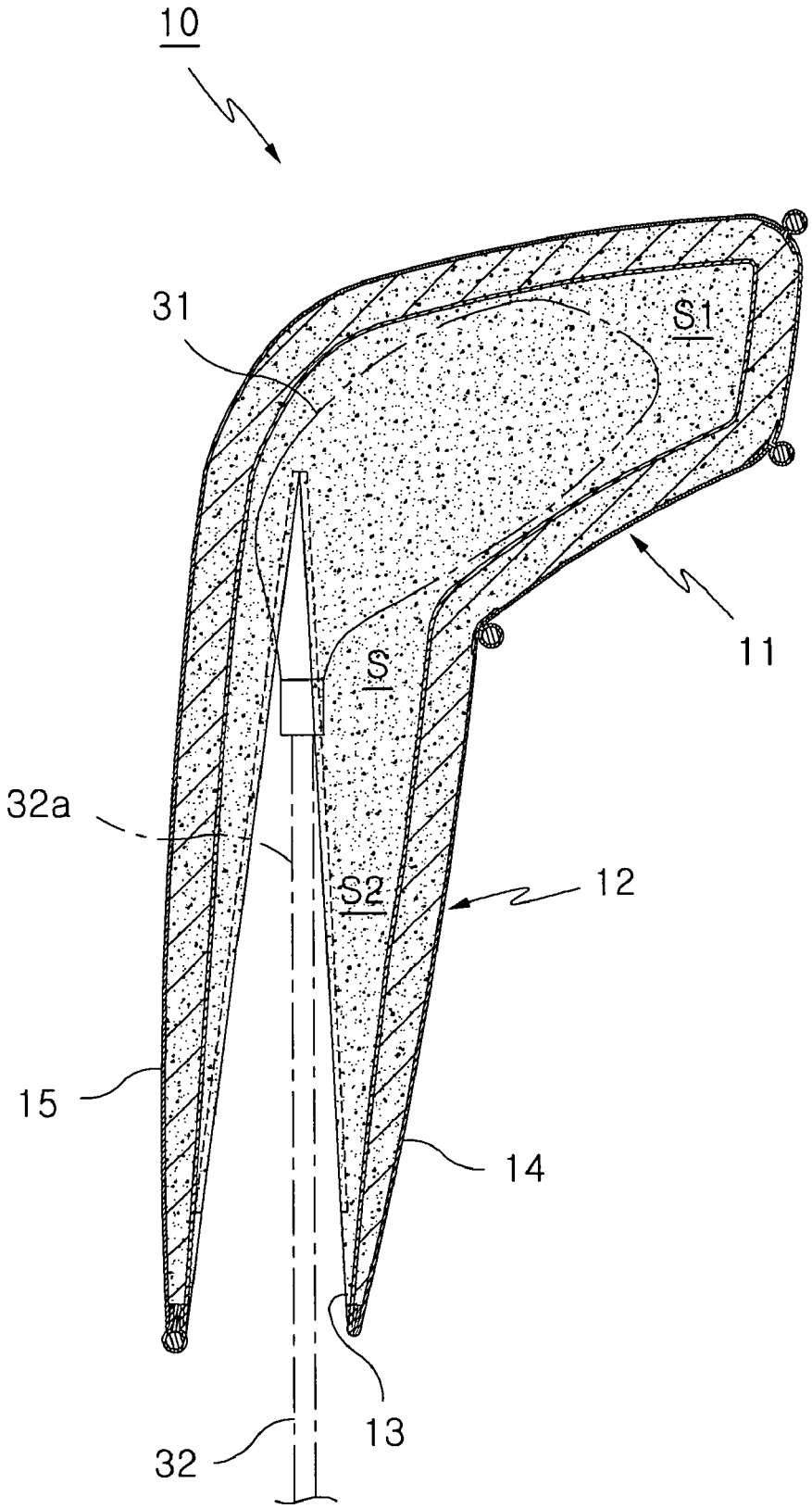
FIG. 3 is a sectional view taken along line A-A of FIG. 2.

Referring to FIGS. 2 and 3, the head cover 10 for golf clubs, according to an embodiment of the present invention, may include a head receiving part 11, a shaft receiving part 12, and fastening members 16. The head receiving part 11 receives a head 31 of a golf club 30. The shaft receiving part 12, having the shape of a bird bill, longitudinally extends from the head receiving part 11 and receives a shaft portion 32*a* provided adjacent to the head 31. The fastening members 16 may detachably fasten the facing upper and lower mandibles 14 and 15 of the shaft receiving part 12 to each other. The end of the shaft receiving part 12 is an opening 13 through which a shaft 32 of the golf club 30 freely passes.

The head cover 10 may be manufactured in a hollow shape using a flexible material. Thus, an internal space S1 of the head receiving part 11 communicates with an internal space S2 of the shaft receiving part 12. Thereby, the head cover 10 has a single receiving space S, which extends longitudinally. The internal space S1 of the head receiving part 11 is isolated from the exterior, whereas the internal space S2 of the shaft receiving part 12 may be opened, just as the bill of a bird is opened.

Each fastening member 16 may be provided on each of the edges 17*a* and 17*b* of the opposing upper and lower mandibles 14 and 15 so that it does not hinder the shaft 32*a* of the golf club 30 from being inserted into the shaft receiving part 12.

Figure 4:
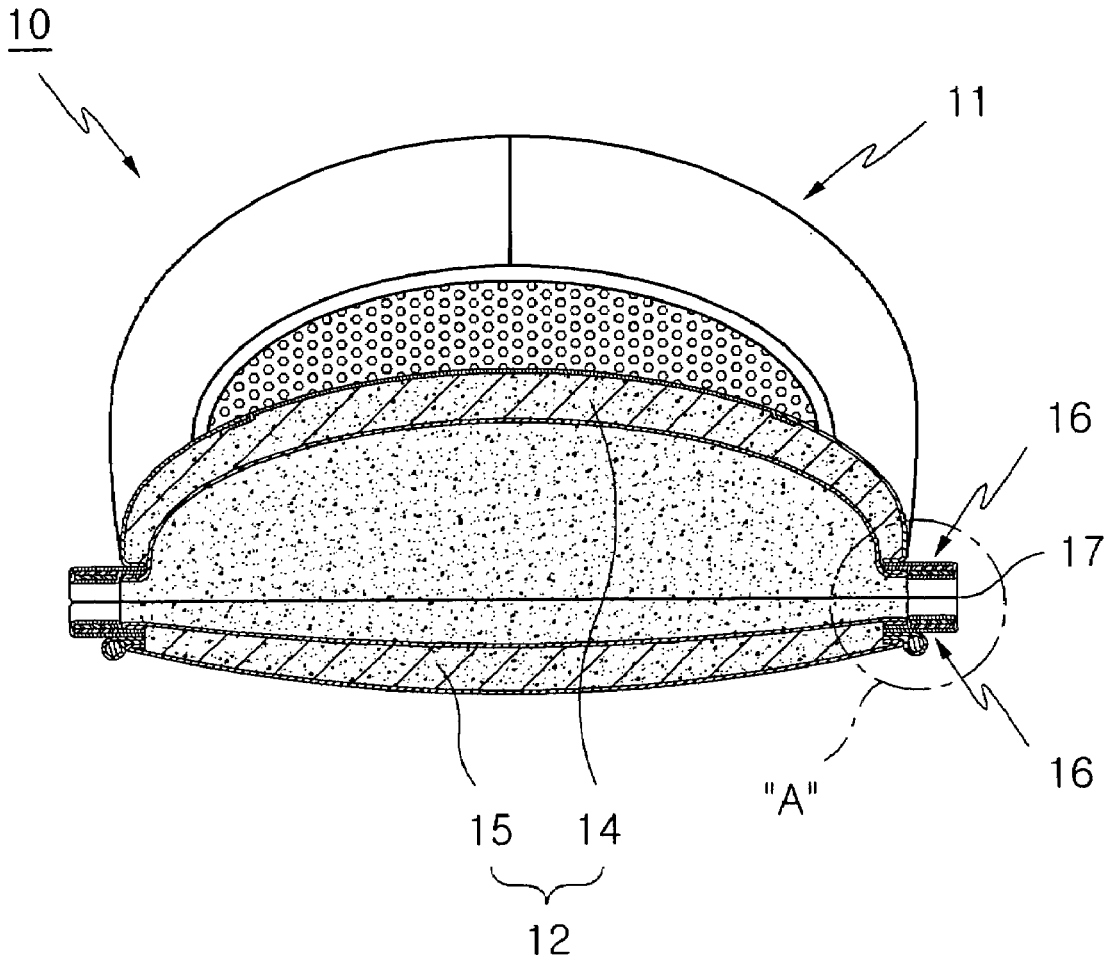
FIG. 4 is a sectional view taken along line B-B of FIG. 2.
Figure 5:
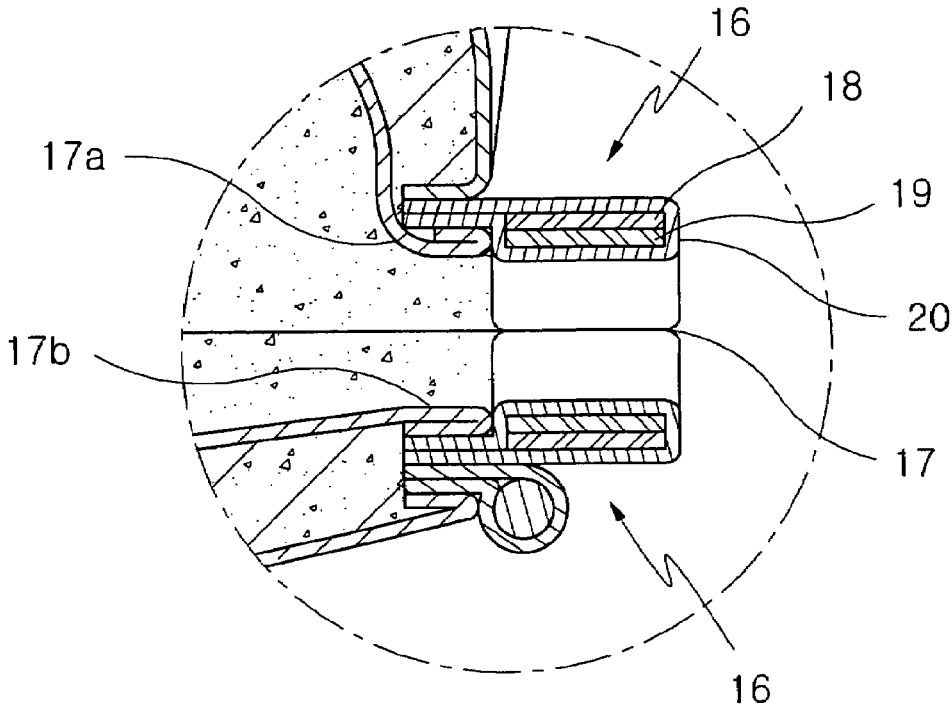
FIG. 5 is an enlarged view of portion "A" of FIG. 4.

Referring to FIGS. 4 and 5, the upper and lower mandibles 14 and 15 may be formed by two slots 17, which extend from opposite sides of the opening 13 to the head receiving part 11. The lower and upper mandibles 14 and 15 can have the same length, and may be parallel to each other. The shaft receiving part 12 can include the upper and lower mandibles 14 and 15, which face each other and are formed as described above, thus having the shape of a bird bill, as shown in FIG. 2.

The fastening members 16 may be provided on the opposing edges 17*a* and 17*b*, forming each slot 17. The fastening members 16 can be operated by a magnetic force and detachably fasten the edges 17*a* and 17*b* forming each slot 17 to each other. Through the operation of each fastening member 16, each slot 17 may be opened or closed. This means that the upper and lower mandibles 14 and 15 can approach each other or move away from each other.

The fastening members 16 may include magnets 18. Each fastening member 16 may also include a metal plate 19 to which the magnets 18 are attached and a fabric covering 20, which covers the metal plate 19. The fastening member 16 is secured to each edge 17*a*, 17*b* by sewing the covering 20 on each edge 17*a*, 17*b*.

Figure 6:
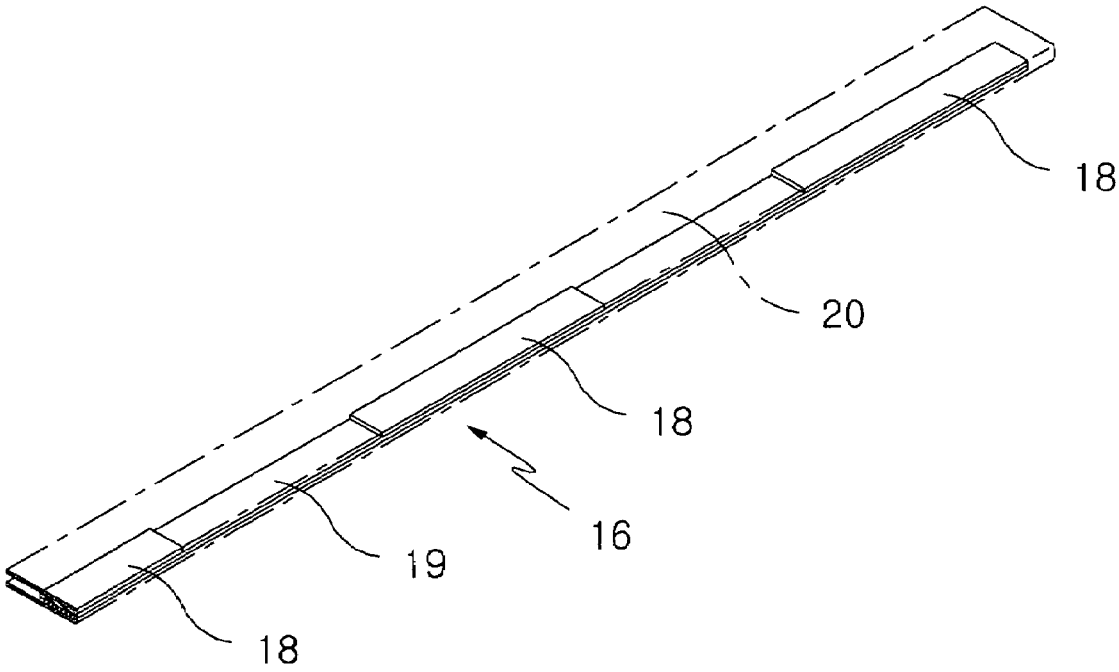
FIG. 6 is a view showing a construction of a fastening member of FIGS. 2 and 5.

Referring to FIG. 6, the magnets 18 can be arranged on the long metal plate 19 in a row such that they are spaced apart from each other. After the magnets 18 are secured to the metal plate 19, the metal plate 19 is covered with the covering 20. According to another embodiment that is not shown, the magnets 18 may be arranged to be spaced apart from each other without using the metal plate 19. Alternatively, the magnets 18 may comprise one long magnet. However, the former case has a drawback in that the slots 17 may not be sufficiently expanded. The latter case is problematic in that the magnet 18 may be cut. In addition, both cases are problematic in that the corresponding edges 17*a* and 17*b* may become misaligned.

Thus, according to the embodiment shown in FIG. 6, the magnets 18 are arranged on the metal plate 19 in a row in such a way as to be spaced apart from each other, thus allowing the slots 17 to be sufficiently expanded, in addition to ensuring the durability of the magnets 18. Further, the magnetic force of the metals 18 is conducted throughout the metal plate 19 so that the entire metal plate 19 is magnetized, thus preventing the misalignment of the corresponding edges 17*a* and 17*b*.

Although it is not required, the metal plate 19 may preferably be a plate made of a shape memory alloy. When the expansion of the slots 17 is repeated, the metal plate 19 may become bent, which causes it to lose its desired flatness. Thus, it is preferable that the metal plate 19 be made of a shape memory alloy, which can be restored to its original shape.

Figure 7:
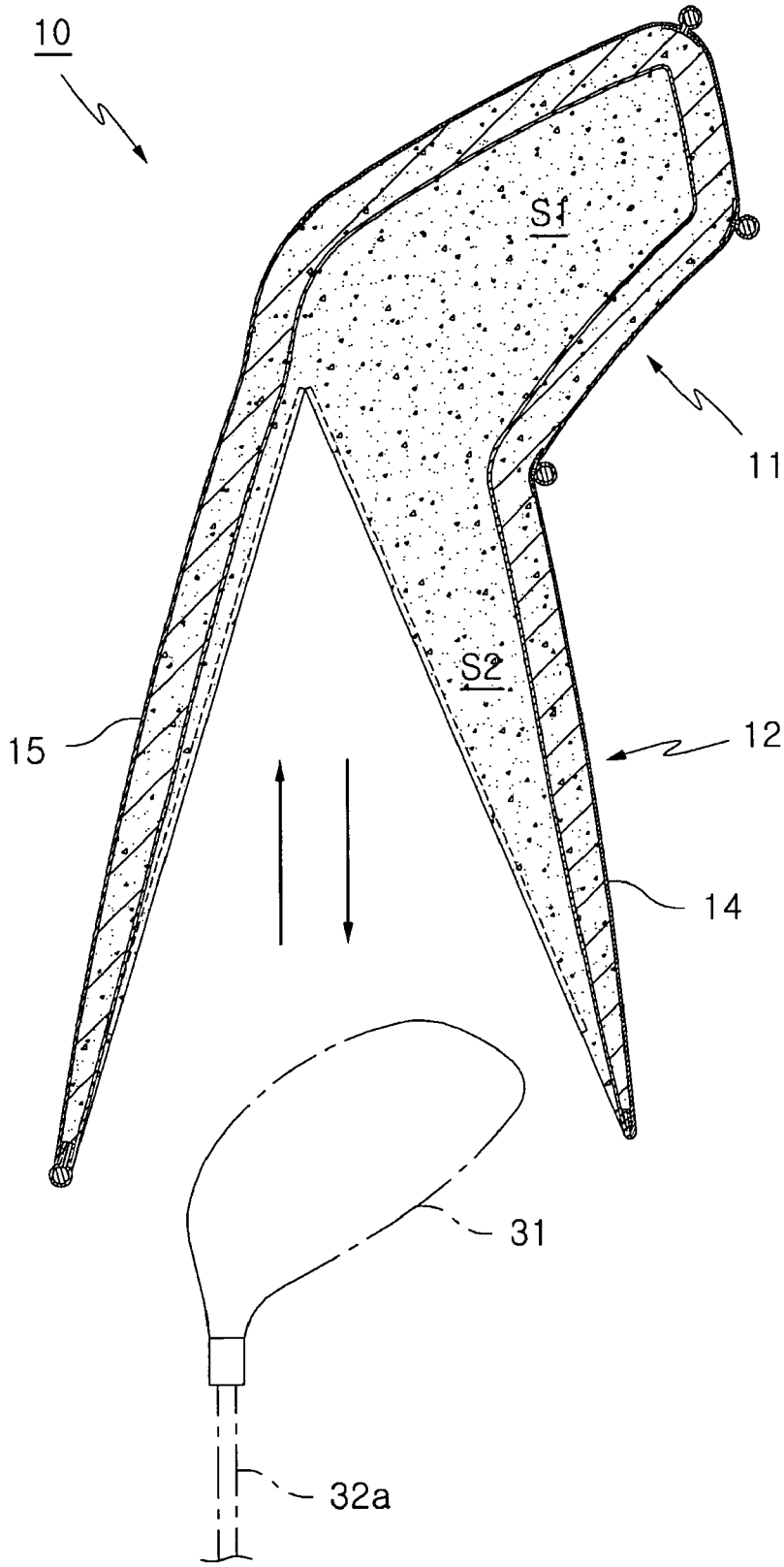
FIG. 7 is a view showing the use of the head cover for golf clubs according to an embodiment of the present invention.

Referring to FIG. 7, the internal space S2 of the shaft receiving part 12 may be sufficiently opened by pulling the upper mandible and lower mandible apart. Thereby, the head 31 of the golf club can be inserted into or taken out of the internal space S1 of the head receiving part 11. After the head 31 of the golf club has been completely inserted into or taken out of the head receiving part 11, the internal space S2 of the shaft receiving part 12 is closed by the magnetic force of the fastening members 16.

Figure 8:
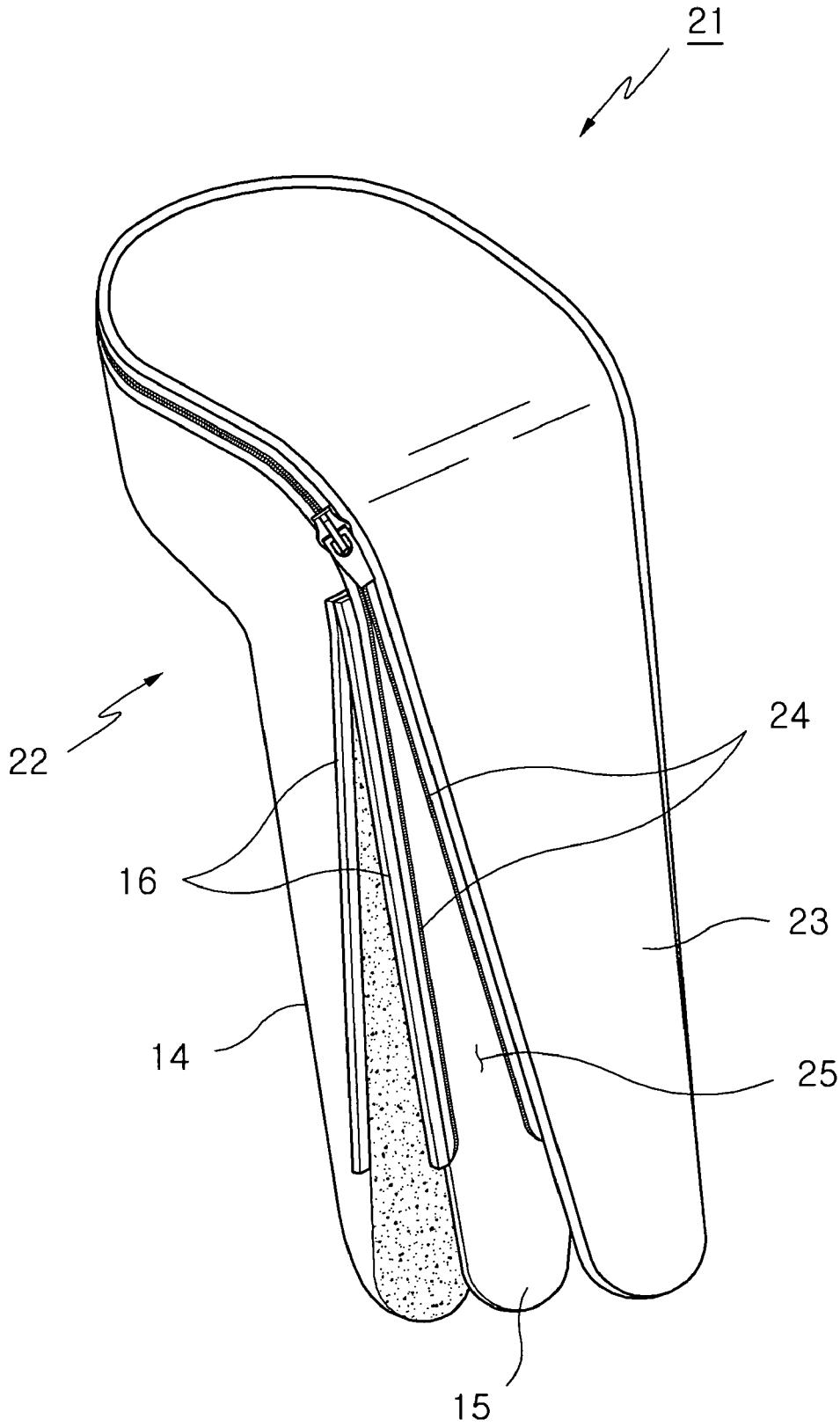
FIG. 8 is a rear perspective view of a head cover for golf clubs according to another embodiment of the present invention.

Referring to FIG. 8, a head cover for golf clubs, according to another embodiment of the present invention, is denoted by reference numeral 21. The head cover 21 may include a cover body 22 and a pocket cover 23. The cover body 22 may have the same shape and construction as the above-mentioned head cover 10 for golf clubs. Meanwhile, the pocket cover 23 is provided on a back side of the lower mandible 15. A pocket 25 is defined between the pocket cover 23 and the lower mandible 15. The pocket 25 may be closed or opened by a fastening member 24 which locks or unlocks the edge of the pocket cover 23 to or from the edge of the lower mandible 15. In one embodiment, the fastening member 24 may preferably be a slide fastener. The pocket 25 is useful for storing thin articles, such as cloth, a handkerchief, or paper.

As described above, the present disclosure provides a head cover 10 for golf clubs, which provides a sufficient space for the ingress and egress of a head 31 of a golf club by pulling an upper mandible and lower mandible 14 and 15 apart. Thus, the head cover 10 may conveniently and rapidly be placed upon or removed from the club head. Further, since there is no possibility of malfunction or trouble during the use of the head cover, the life-span of the head cover is prolonged in comparison with the conventional head cover.

It should be understood that the present invention is not limited to the particular embodiments shown and described above, and various changed and modifications may be made without departing from the spirit and scope of the appended claims.

What is claimed is:

1. A head cover for a golf club comprising:

a head receiving part configured to receive a head of the golf club therein;

a shaft receiving part having a shape of a bird bill, extending longitudinally from the head receiving part, having a first end opening, and configured to receive a shaft portion adjacent to the head of the golf club, wherein the shaft receiving part comprises facing upper and lower mandibles; and a fastening member to detachably fasten the facing upper and lower mandibles of the shaft receiving part, wherein the upper and lower mandibles each has edges, wherein the fastening member comprises:

at least one magnet;

a metal plate to which the at least one magnet is attached; and a fabric covering to cover the metal plate, wherein the fabric covering is secured to each of the edges of the upper and lower mandibles through a sewing method, wherein the at least one magnet is a plurality of magnets arranged on the metal plate in a row in such a way as to be spaced apart from each other.

2. The head cover according to claim 1, wherein the shaft receiving part has a second end opening, wherein the upper and lower mandibles are formed by two slots which extend on opposite sides of the second end opening to the head receiving part, and wherein the upper and lower mandibles have the same length.

3. The head cover according to claim 1, wherein the upper and lower mandibles each has edges, and wherein the fastening member is provided on each of the edges of the opposing upper and lower mandibles.

4. The head cover according to claim 1, wherein the metal plate comprises a shape memory alloy.

5. The head cover according to claim 1, wherein the head receiving part is made of a flexible material.

6. A head cover for a golf club comprising:

a head receiving part configured to receive a head of the golf club therein;

a shaft receiving part having a shape of a bird bill, extending longitudinally from the head receiving part, having a first end opening, and configured to receive a shaft portion adjacent to the head of the golf club, wherein the shaft receiving part comprises facing upper and lower mandibles;

a fastening member to detachably fasten the facing upper and lower mandibles of the shaft receiving part; and a pocket cover provided on a back side of the lower mandible, wherein a pocket is defined between the pocket cover and the lower mandible, and wherein the pocket is closed or opened by another fastening member that locks or unlocks an edge of the pocket cover to or from an edge of the lower mandible.

7. The head cover according to claim 6, wherein the fastening member comprises at least one magnet.

8. A head cover for a golf club comprising:

a head receiving part configured to receive a head of the golf club therein;

a shaft receiving part having a shape of a bird bill with facing upper and lower mandibles;

a fastening member to detachably fasten the facing upper and lower mandibles of the shaft receiving part; and a pocket cover provided on a back side of the lower mandible, wherein a pocket is defined between the pocket cover and the lower mandible, and wherein the pocket is closed or opened by another fastening member that locks or unlocks an edge of the pocket cover to or from an edge of the lower mandible.

9. The head cover according to claim 8, wherein the shaft receiving part has an end opening, wherein the upper and lower mandibles are formed by two slots on opposite sides of the end opening to the head receiving part.

10. The head cover according to claim 8, wherein the upper and lower mandibles each has edges, and wherein the fastening member is provided on an edge of each of the opposing upper and lower mandibles.

11. The head cover according to claim 8, wherein the fastening member comprises at least one magnet.

* * * * *